US007163437B1

(12) United States Patent
Swedek et al.

(10) Patent No.: US 7,163,437 B1
(45) Date of Patent: Jan. 16, 2007

(54) SYSTEM WITH SEALED POLISHING PAD

(75) Inventors: Bogdan Swedek, Cupertino, CA (US); David J. Lischka, San Jose, CA (US); Jeffrey Drue David, San Jose, CA (US); Dominic J. Benvegnu, La Honda, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/400,079

(22) Filed: Apr. 5, 2006

Related U.S. Application Data

(62) Division of application No. 11/213,623, filed on Aug. 26, 2005.

(51) Int. Cl.
*B24B 7/22* (2006.01)

(52) U.S. Cl. ..... 451/6; 451/8

(58) Field of Classification Search ..... 451/5, 451/6, 8, 283, 285, 289, 526, 533, 534, 537
See application file for complete search history.

(56) References Cited

U.S. PATENT DOCUMENTS 5,081,796 A 1/1992 Schultz
5,605,760 A 2/1997 Roberts
5,609,511 A 3/1997 Moriyama et al.
5,738,574 A 4/1998 Tolles et al.
5,893,796 A 4/1999 Birang et al.
6,068,539 A 5/2000 Bajaj et al.
6,217,410 B1 4/2001 Holzapfel et al.
6,599,765 B1 7/2003 Boyd et al.
6,620,036 B1 9/2003 Freeman et al.
6,621,264 B1 9/2003 Lehman et al.
6,719,818 B1 * 4/2004 Birang et al. ..... 51/296
6,991,517 B1 1/2006 Redeker et al.
6,994,607 B1 2/2006 Wiswesser
2004/0248501 A1 12/2004 Kim et al.
2005/0090105 A1 * 4/2005 Elledge ..... 438/689
2005/0266771 A1 * 12/2005 Wiswesser ..... 451/5

* cited by examiner

*Primary Examiner*—Jacob K. Ackun, Jr.
(74) *Attorney, Agent, or Firm*—Fish & Richardson

(57) ABSTRACT

A polishing pad, polishing system, method of making a polishing pad and method of using a polishing pad. The polishing pad includes a polishing layer having a polishing surface, a backing layer with an aperture and a first portion that is permeable to liquid, and a sealant that penetrates a second portion of the backing layer adjacent to and surrounding the aperture such that the second portion is substantially impermeable to liquid. The aperture is positioned below a substantially fluid-impermeable element.

15 Claims, 2 Drawing Sheets

SYSTEM WITH SEALED POLISHING PAD

CROSS-REFERENCE TO RELATED APPLICATION

This application is a divisional (and claims the benefit of priority under 35 USC 120) of U.S. patent application Ser. No. 11/213,623, filed on Aug. 26, 2005. The disclosure of the prior application is considered part of (and is incorporated by reference in) the disclosure of this application.

BACKGROUND

This present invention relates to chemical mechanical polishing.

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing liquid, which can include abrasive particles, is supplied to the surface of the polishing pad.

In general, there is a need to detect when the desired surface planarity or layer thickness has been reached or when an underlying layer has been exposed in order to determine whether to stop polishing. Several techniques have been developed for the in-situ detection of endpoints during the CMP process. For example, an optical monitoring system for in-situ measuring of uniformity of a layer on a substrate during polishing of the layer has been employed. The optical monitoring system can include a light source that directs a light beam toward the substrate during polishing, a detector that measures light reflected from the substrate, and a computer that analyzes a signal from the detector and calculates whether the endpoint has been detected. In some CMP systems, the light beam is directed toward the substrate through a window in the polishing pad.

SUMMARY

The invention provides methods and apparatus for sealing a portion of a polishing pad to prevent liquid from collecting on a bottom surface of a window.

In one aspect, the invention is directed to a polishing pad for use in a chemical mechanical polishing system. The polishing pad includes a polishing layer having a polishing surface. a backing layer including a first portion that is permeable to liquid, a window from the polishing surface to a bottom surface of the polishing pad, and a sealant. The window includes a transparent portion that is substantially impermeable to liquid secured to the polishing pad and an aperture in the backing layer aligned with the transparent portion and positioned on a side of the transparent portion opposite the polishing surface. The sealant penetrate a second portion of the backing layer adjacent to and surrounding the aperture such that the second portion is substantially impermeable to liquid.

Implementations of the invention may include one or more of the following features. The backing layer may be a foam. The sealant may be silicone. The polishing layer may be generally impermeable to liquid. A top surface of the transparent portion may be coplanar with the polishing surface. A bottom surface of the transparent portion may be coplanar with a lower surface of the polishing layer. The first portion may extends adjacent to an outer peripheral edge of the backing layer. A recess may be formed in the lower surface of the transparent portion.

In one aspect, the invention is directed to a polishing system. The polishing system includes a polishing pad, a platen, and a monitoring module. The polishing pad includes a polishing layer having a polishing surface and a backing layer with an aperture and a first portion that is permeable to liquid. The aperture is positioned below a substantially fluid-impermeable element, and a sealant that penetrates a second portion of the backing layer adjacent to and surrounding the aperture such that the second portion is substantially impermeable to liquid. The platen supports the polishing pad and includes a second recess, and the monitoring module is positioned in the recess. A volume is formed at least in part between a lower surface of the fluid-impermeable element and an upper surface of the optical monitoring module.

Implementations of the invention may include one or more of the following features. The monitoring module may be an optical monitoring module and fluid-impermeable element may be transparent. A purge system may direct a purge gas into the volume and/or draw fluid out of the volume. The purge gas may include clean dry air, nitrogen, or inert gas. The purge system may include an exit passage connected to an external environment. A portion of the monitoring module may extend into the polishing pad. The sealant may be silicone. The fluid-impermeable element may be the polishing layer.

In another aspect, the invention is directed to a method of making a polishing pad. The method includes securing a polishing layer with a polishing surface to a backing layer with a first portion that is permeable to liquid, forming a window from the polishing surface to a bottom surface of the polishing pad, and applying a sealant. The window includes a transparent portion that is substantially impermeable to liquid secured to the polishing pad and an aperture in the backing layer aligned with the transparent portion and positioned on a side of the transparent portion opposite the polishing surface. The sealant penetrates a second portion of the backing layer adjacent to and surrounding the aperture such that the second portion is substantially impermeable to liquid.

Implementations of the invention may include one or more of the following features. The sealant may be applied after the aperture in the backing layer is formed, after the window is formed, or after the polishing layer is secured to the backing layer.

The invention can provide one or more of the following advantages. Collection of liquid on the bottom surface of the window, such as by condensation or fogging, can be reduced. This can improve optical signal strength, thus reducing noise, and thereby improve endpoint detection reliability.

The details of one or more embodiments of the invention are set forth in the accompanying drawings and the description below. Other features, objects, and advantages of the invention will be apparent from the description and drawings.

DESCRIPTION OF DRAWINGS

Like reference symbols in the various drawings indicate like elements.

DETAILED DESCRIPTION

Figure 1:
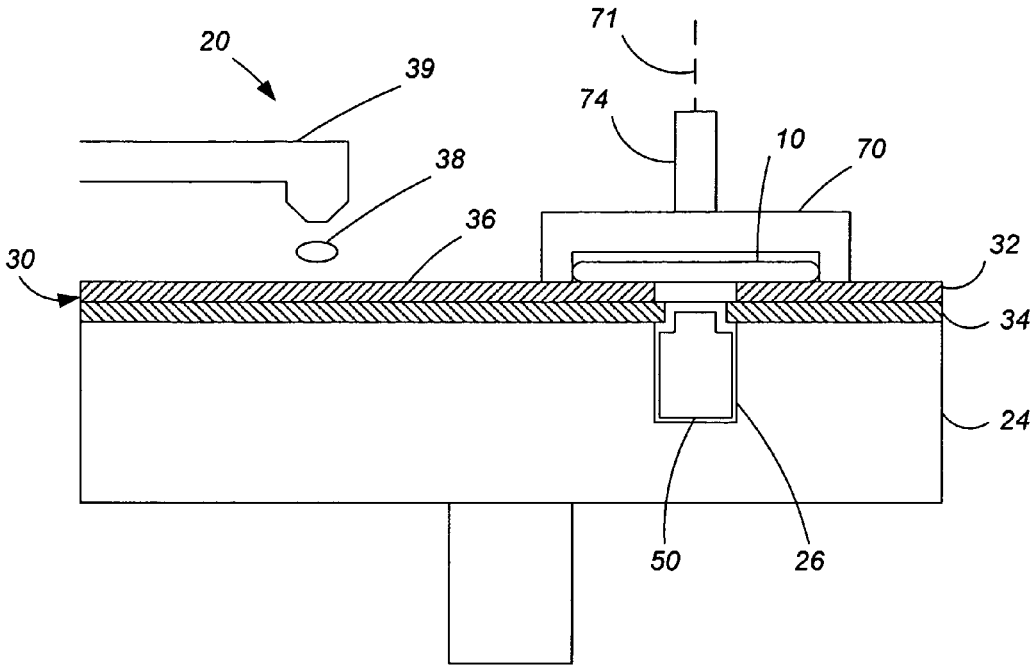
FIG. 1 is a schematic side view, partially cross-sectional, of a chemical mechanical polishing station with a polishing pad according to the present invention.

As shown in FIG. 1, one or more substrates 10 can be polished by a CMP apparatus 20. A description of a suitable polishing apparatus 20 can be found in U.S. Pat. No. 5,738,574, the entire disclosure of which is incorporated herein by reference.

The polishing apparatus 20 includes a rotatable disk-shaped platen 24 on which is placed a polishing pad 30. The polishing pad 30 can be secured to the platen 24, e.g., by a layer of adhesive. The polishing pad 30 can be a two-layer polishing pad with an outer cover layer or polishing layer 32 that provides a polishing surface 36, and a backing layer 34. In general, although the outer polishing layer is roughened and can transport slurry, it is generally fluid-impermeable. The outer polishing layer 32 may be a cast polyurethane with fillers, such as a layer of IC-1000 from Rodel. In addition, the polishing The backing layer 34 is typically softer than the polishing layer 32, and may be formed from a foam or fibrous mat, such as a layer of PORON, e.g., PORON 4701-30 from Rogers Corporation, or Suba-IV from Rodel, that can be fluid-permeable. Slurry transport grooves may be formed in the polishing surface by a milling or molding process.

The polishing station can also include a pad conditioner apparatus to maintain the condition of the polishing pad so that it will effectively polish substrates. During a polishing step, a polishing liquid 38, e.g., a slurry, containing a liquid and a pH adjuster can be supplied to the surface of polishing pad 30 by a slurry supply port or combined slurry/rinse arm 39. The polishing liquid 38 can also include abrasive particles.

A carrier head 70 can hold the substrate 10 against the polishing pad 30. The carrier head 70 is suspended from a support structure, for example, a carousel, and is connected by a carrier drive shaft 74 to a carrier head rotation motor so that the carrier head can rotate about an axis 71. In addition, the carrier head 70 can oscillate laterally in a radial slot formed the support structure 72. In operation, the platen is rotated about its central axis 25, and the carrier head is rotated about its central axis 71 and translated laterally across the top surface of the polishing pad. A description of a suitable carrier head 70 can be found in U.S. patent application Ser. Nos. 09/470,820, 09/535,575 and 10/810,784, filed Dec. 23, 1999, Mar. 27, 2000, and Mar. 26, 2004, the entire disclosures of which are incorporated by reference.

A recess 26 is formed in the platen 24, and an in-situ monitoring module 50 of an in-situ monitoring system fits into the recess 26. The in-situ monitoring system can be an optical monitoring system, or a combination of an optical monitoring system with another type of monitoring system such as an eddy current monitoring system. The in-situ monitoring module 50 can include one or more sensor elements, which provide better resolution when they are situated close to the substrate being polished. Examples of a sensor element include but are not limited to an optical fiber and a ferromagnetic core. A suitable in-situ modules is further described in commonly owned U.S. patent application Ser. No. 09/847,867, filed on May 2, 2001, Ser. No. 10/124,507, filed on Apr. 16, 2002, Ser. No. 10/123,917, also filed on Apr. 16, 2002, and Ser. No. 10/633,276, filed on Jul. 31, 2003, which are hereby incorporated by reference in their entireties. In some implementations, the monitoring system might not include an optical monitoring system. In this case, the pad need not include a transparent portion, although the monitoring module should be positioned below a fluid-impermeable element, e.g., an opaque plug or the polishing layer itself.

Figure 2:
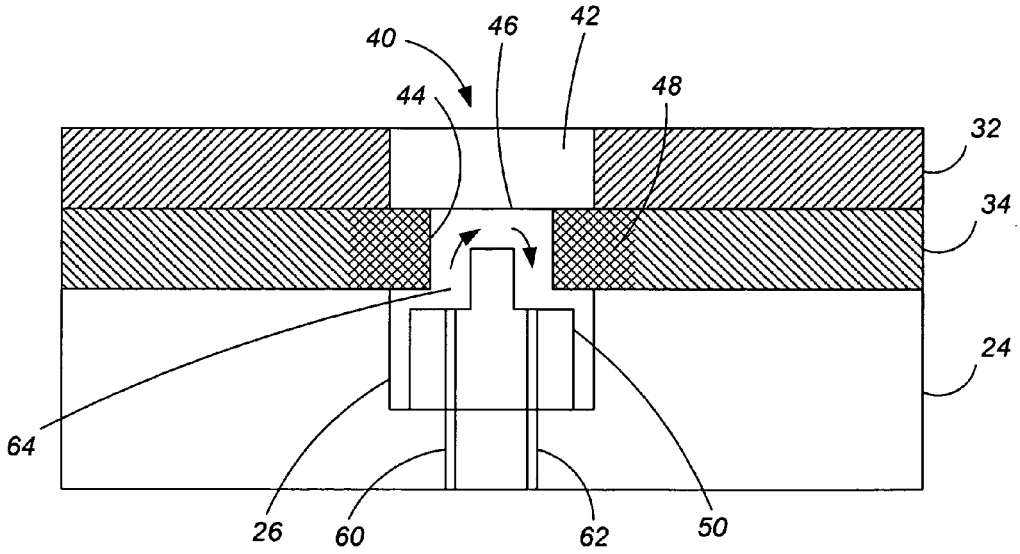
FIG. 2 is an enlarged cross-sectional view of a portion of the polishing pad on a platen.
Figure 3:
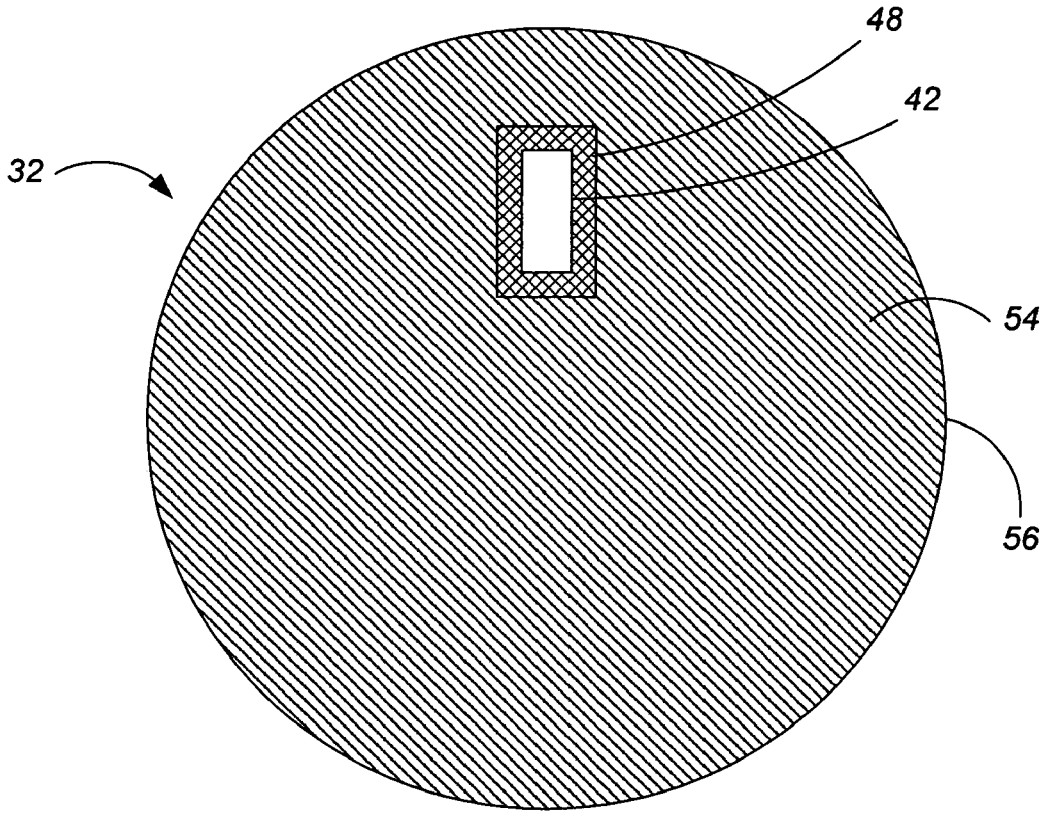
FIG. 3 is a schematic bottom view of the polishing pad.

Referring to FIGS. 2 and 3, the polishing pad can include a solid transparent portion 42 that provides a window 40. The transparent portion 42 can be an integral portion of the polishing pad, or it can be an element secured, e.g., molded or adhesively attached, to the polishing pad. In particular, the window 40 can include a transparent portion 42 positioned in the polishing layer 32 with generally the same thickness as the polishing layer, and an aperture 44 in the backing layer 34 that is aligned with the transparent portion 42. A top surface of the transparent portion 42 can be co-planar with the polishing surface 36. In addition, one or more optional recesses can be formed in the bottom surface 46 of the transparent portion 42 that extend partially but not entirely through the transparent portion. In general, the material of the transparent portion 42 should be non-magnetic and non-conductive. The plug can be a relatively pure polymer or polyurethane, for example, formed without fillers, or the plug can be formed of a fluorocarbon, such as Teflon, or a polycarbonate. In an implementation in which the window includes a rigid crystalline portion or glass-like portion and the recess is formed in the bottom surface of this portion by machining, the recess can be polished so as to remove scratches caused by the machining. Alternatively, a solvent and/or a liquid polymer can be applied to the surfaces of the recess to remove scratches caused by machining. The removal of scratches usually caused by machining reduces scattering and can improve the transmittance of light through the window.

In general, the transparent portion 42 is secured to the polishing pad so as to prevent fluid from flowing from the polishing surface 36 into the region below the transparent surface. In one implementation, forming the window 40 includes cutting a hole in the polishing layer 32 and securing the transparent portion 42 in the hole. For example, the transparent portion 42 may secured by an adhesive to the backing layer 34 and/or to the polishing layer 32. The adhesive can form a slurry-tight seal between the transparent potion 42 and the polishing layer 32 and/or backing layer 34. As another example, the transparent portion 42 can be secured by dispensing a liquid window material into the hole and curing the liquid to mold the transparent portion 42 in place. In another implementation, forming the window 40 includes forming the transparent portion 42 during fabrication of the polishing layer 32. For example, a transparent plug can be positioned in a liquid pad material, and the liquid pad material can be cured to solidify the polishing layer 32 around the transparent portion 42. In either case where the transparent portion is molded to the polishing layer, the window may be formed in a cast block of pad material from which the polishing layer (including transparent portion) is then cut. Where the transparent portion 42 is to be secured directly to the polishing layer 32, the securing step can occur before or after the polishing layer 32 is attached to the backing layer 34.

The window 40 is situated over at least a portion of the recess 26 and the module 50. The module 50 and window 40 are positioned such that they pass beneath substrate 10 during a portion of the platen's rotation. In some implementations, a portion of the module 50, such as a ferromagnetic core, extends into and partially (but not entirely) through the polishing pad 30.

Optionally, the module 50 can include a purge system to purge liquids and gases from a volume 64 between the top surface of the module 50 and the bottom surface of the transparent portion 42. The purge system can include a fluid inlet line 60 coupled to a purge gas source, and a fluid outlet line 62 that can be coupled to a vacuum source. In general, the fluid lines 60 and 62 will extend through the platen and through a rotary coupling to the purge gas source and vacuum source. Although illustrated as extending through the module 50, the fluid lines 60 and 62 can be connected directly to the volume 64 without passing through the module 50. Alternatively, the fluid outlet line 62 can simply extend to the external environment, in which case the outline line may simply pass through the platen (and not through the rotary coupling).

In operation, the purge gas can flow continuously through the volume 64, preventing water vapor from accumulating in the volume and thus preventing condensation or fogging on the bottom surface of the transparent portion 42. The purge gas can be a composition, e.g., clean dry air, nitrogen, or an inert gas, that does not interfere with the polishing process, does not damage the polishing pad, and does not include vapor which might condense.

One potential problem is that, if the backing layer 34 is fluid-permeable, the suction generated by the fluid outline line 62 can draw liquid from the edge of the backing layer into the volume 64. This can result in condensation or fogging, even if a purge gas is flowing through the volume 64.

To address this issue, a portion 48 of the backing layer 34 can be made substantially impermeable to liquid so that liquid will not reach the volume 64. In particular, a portion 48 of the backing layer immediately adjacent the aperture 44 can have a permeability much lower than that of the remaining portion 54 of the backing layer 34. The remaining portion 54 can include a portion at the peripheral edge 56 of the backing layer 34.

To create the impermeable portion, a sealant can be applied to the backing layer so that the sealant permeates the backing layer. The sealant penetrates the backing layer to plug pores, thus providing the fluid-impermeable portion 48 of the backing layer. The sealant can be, for example, silicone, or another polymer sealant. The sealant may be applied in liquid form and then harden, e.g., be cured. The sealant can be applied before or after the backing layer is attached to polishing layer, and can be applied before or after the window is completed.

The above described apparatus and methods can be applied in a variety of polishing systems. Either the polishing pad, or the carrier head, or both can move to provide relative motion between the polishing surface and the substrate.

The polishing pad can be a circular (or some other shape) pad secured to the platen. Terms of relative positioning are used; it should be understood that the polishing surface and substrate can be held in a vertical orientation or some other orientation. The polishing layer can be a standard (for example, polyurethane with or without fillers) polishing material, a soft material, or a fixed-abrasive material. The entire polishing layer can be transparent, and a portion of the opaque backing layer can be removed to provide the window. There may be additional layers between the backing layer and the polishing layer, or below the polishing layer. A portion of the transparent portion may project into the aperture in the backing layer. The aperture in the backing layer may be larger than the aperture in the polishing layer, and the transparent portion may be secured to a lip on the underside of the polishing layer.

A number of embodiments of the invention have been described. Nevertheless, it will be understood that various modifications may be made without departing from the spirit and scope of the invention. Accordingly, other embodiments are within the scope of the specification.

What is claimed is:

1. A polishing system, comprising:

a polishing pad that includes a polishing layer having a polishing surface, a backing layer with an aperture and a first portion that is permeable to liquid, the aperture below a substantially fluid-impermeable element, and a sealant that penetrates a second portion of the backing layer adjacent to and surrounding the aperture such that the second portion is substantially impermeable to liquid;

a platen that supports the polishing pad and that includes a recess; and a monitoring module in the recess, a volume formed at least in part between a lower surface of the fluid-impermeable element and an upper surface of the monitoring module.

2. The polishing system of claim 1, wherein the monitoring module is an optical monitoring module, and the fluid-impermeable element is substantially transparent.

3. The polishing system of claim 1, wherein the monitoring module is not an optical monitoring module, and the fluid-impermeable element is opaque.

4. The polishing system of claim 1, further comprising a purge system to direct a purge gas into the volume.

5. The polishing system of claim 4, wherein the purge wherein the purge gas is selected from the group consisting of clean dry air, nitrogen, and inert gases.

6. The polishing system of claim 4, wherein the purge system is configured to draw fluid out of the volume.

7. The polishing system of claim 4, wherein the purge system further comprises an exit passage connected to an external environment.

8. The polishing system of claim 1, further comprising a purge system to draw fluid out of the volume.

9. The polishing system of claim 1, wherein a portion of the monitoring module extends into the polishing pad.

10. The polishing system of claim 1, wherein the sealant comprises silicone.

11. The polishing system of claim 1, wherein the fluid-impermeable element comprises the polishing layer.

12. The polishing system of claim 1, wherein the fluid-impermeable element comprises a plug secured in an aperture in the polishing layer.

13. The polishing system of claim 1, wherein the platen is rotatable.

14. The polishing system of claim 1, wherein the backing layer comprises a foam.

15. The polishing system of claim 1, wherein the backing layer comprises a fibrous mat.

* * * * *